US009295888B2

(12) United States Patent
Fujiwara et al.

(10) Patent No.: US 9,295,888 B2
(45) Date of Patent: Mar. 29, 2016

(54) SHAFT FOR GOLF CLUB HAVING RIGIDITY IMPROVED AT INTERMEDIATE PART

(71) Applicants: Kosuke Fujiwara, Yokohama (JP); Naruki Yatsuda, Yokohama (JP)

(72) Inventors: Kosuke Fujiwara, Yokohama (JP); Naruki Yatsuda, Yokohama (JP)

(73) Assignee: NHK Spring Co., Ltd., Kanagawa (JP)

( * ) Notice: Subject to any disclaimer, the term of this patent is extended or adjusted under 35 U.S.C. 154(b) by 115 days.

(21) Appl. No.: 13/829,066

(22) Filed: Mar. 14, 2013

(65) Prior Publication Data

US 2014/0045605 A1 Feb. 13, 2014

(30) Foreign Application Priority Data

Aug. 9, 2012 (JP) ..... 2012-177005

(51) Int. Cl.
*A63B 53/10* (2015.01)
*A63B 53/12* (2015.01)

(52) U.S. Cl.
CPC ..... *A63B 53/10* (2013.01); *A63B 53/12* (2013.01); *A63B 2209/02* (2013.01)

(58) Field of Classification Search
CPC ..... A63B 53/10; A63B 53/12; A63B 2209/02
See application file for complete search history.

(56) References Cited

U.S. PATENT DOCUMENTS

| | | | | | |
|---|---|---|---|---|---|
| 2,153,880 | A | | 4/1939 | Barnhart | |
| 4,330,126 | A | * | 5/1982 | Rumble | 473/323 |
| 5,251,896 | A | * | 10/1993 | Gerlach | 473/317 |
| 5,265,872 | A | | 11/1993 | Tennent et al. | |
| 5,413,338 | A | * | 5/1995 | Kawamatsu | 473/319 |
| 5,427,373 | A | * | 6/1995 | Kusumoto | 473/319 |
| 5,496,028 | A | * | 3/1996 | Chien | 473/319 |
| 5,551,691 | A | * | 9/1996 | Harada et al. | 473/323 |
| 5,573,468 | A | * | 11/1996 | Baumann | 473/312 |
| 5,632,692 | A | * | 5/1997 | Lebovici | 473/317 |
| 5,665,010 | A | * | 9/1997 | Mori | 473/316 |
| D385,608 | S | * | 10/1997 | Hoffmeyer | D21/757 |
| 5,735,753 | A | * | 4/1998 | Hoffmeyer | 473/318 |
| 5,755,826 | A | * | 5/1998 | Beach et al. | 473/316 |
| 5,776,008 | A | * | 7/1998 | Lundberg | 473/320 |
| 5,813,922 | A | * | 9/1998 | Beach et al. | 473/319 |
| 5,865,688 | A | * | 2/1999 | Bae | 473/323 |
| 5,882,268 | A | * | 3/1999 | McIntosh et al. | 473/316 |
| 5,938,542 | A | * | 8/1999 | Hoffmeyer | 473/318 |
| 6,231,457 | B1 | * | 5/2001 | Chen | 473/319 |
| 6,322,458 | B1 | * | 11/2001 | Kusumoto et al. | 473/316 |
| 6,431,996 | B1 | * | 8/2002 | Wright et al. | 473/318 |
| 6,485,376 | B1 | | 11/2002 | Hisamatsu | |

(Continued)

FOREIGN PATENT DOCUMENTS

| | | |
|---|---|---|
| DE | 10 2005 030 373 | 8/2006 |
| GB | 2 313 321 | 11/1997 |

(Continued)

*Primary Examiner* — Stephen Blau
(74) *Attorney, Agent, or Firm* — Jordan and Hamburg LLP

(57) ABSTRACT

A shaft for a golf club is capable of hitting a higher ball and reducing a spin on the ball. The shaft has a distal part that is provided with a clubhead, a proximal part that is provided with a grip, an intermediate part arranged between the distal and proximal parts, and a thick part set to thicken a wall thickness of the intermediate part relative to the distal part, a reinforcing part set at the intermediate part, or a combination of the thick part and the reinforcing part. With this, the shaft improves a rigidity at the intermediate part so that a change in rigidity between the distal part and the intermediate part has an inflection point.

1 Claim, 12 Drawing Sheets

(56) References Cited

U.S. PATENT DOCUMENTS

| | | | | |
|---|---|---|---|---|
| 6,641,489 | B1 * | 11/2003 | Wright et al. | 473/318 |
| 7,955,187 | B2 * | 6/2011 | Bone et al. | 473/316 |

FOREIGN PATENT DOCUMENTS

| | | |
|---|---|---|
| JP | 36-20933 | 8/1961 |
| JP | 57-59563 | 4/1982 |
| JP | 3033320 | 10/1996 |
| JP | 10-000252 | 1/1998 |
| JP | 10-216280 | 8/1998 |
| JP | 2003-135636 | 5/2003 |
| WO | WO-81/00520 | 3/1981 |
| WO | WO-98/23338 | 6/1998 |

* cited by examiner

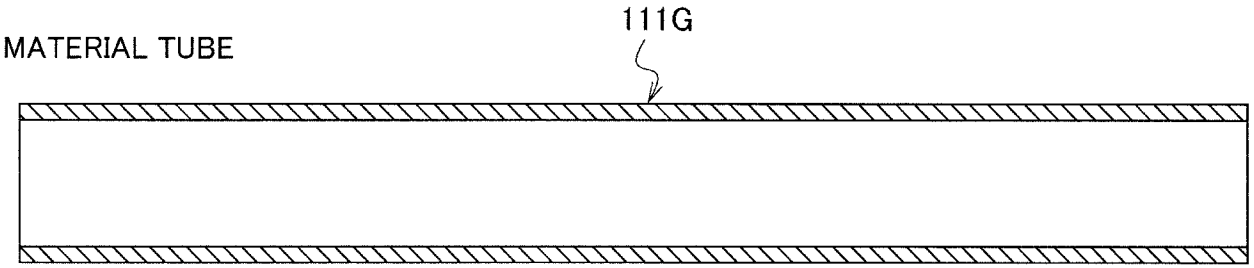
FIG.11A MATERIAL TUBE
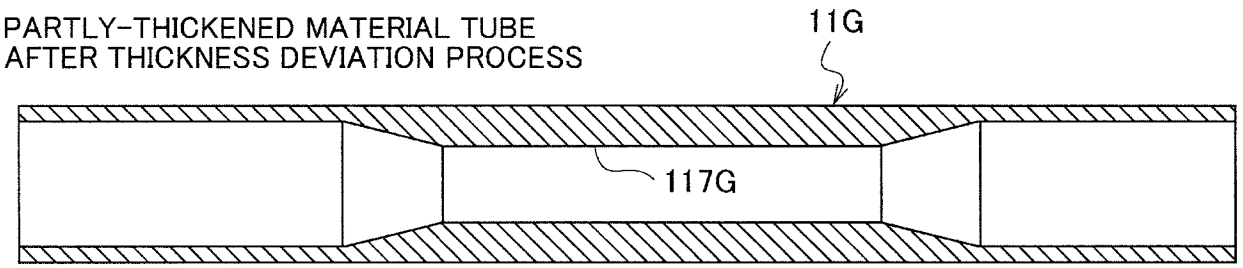
FIG.11B PARTLY-THICKENED MATERIAL TUBE AFTER THICKNESS DEVIATION PROCESS
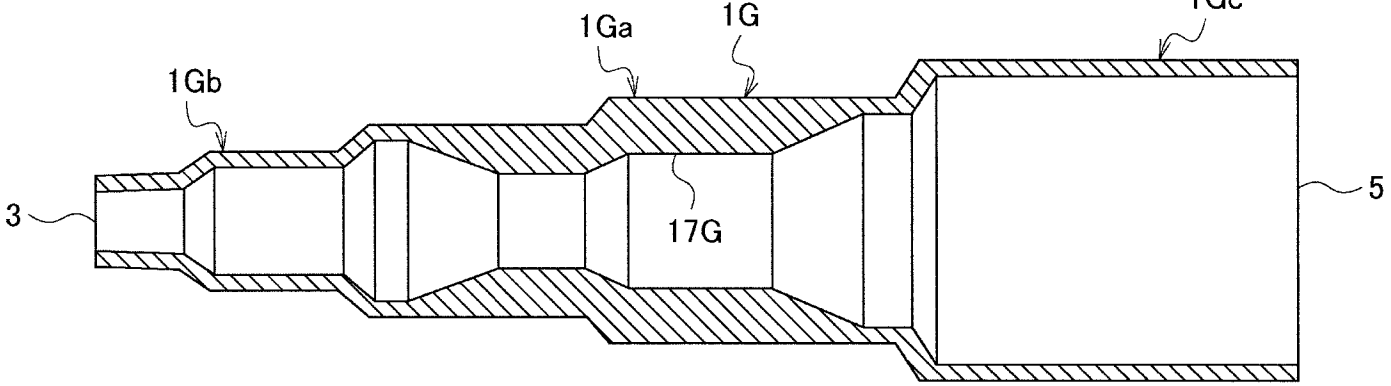
FIG.11C STEPPED SHAFT AFTER STEPPING PROCESS FIG.12A NO THICKNESS DEVIATION PROCESS
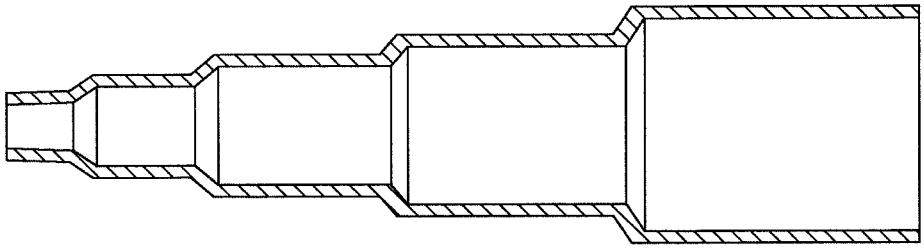
FIG.12B THICKNESS DEVIATION PROCESS AT INTERMEDIATE PART
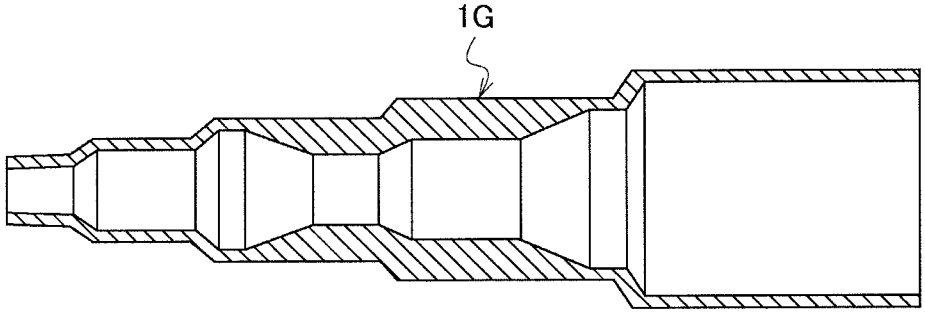
FIG.12C THICKNESS DEVIATION PROCESS AT DISTAL PART
: COMPARATIVE EXAMPLE A
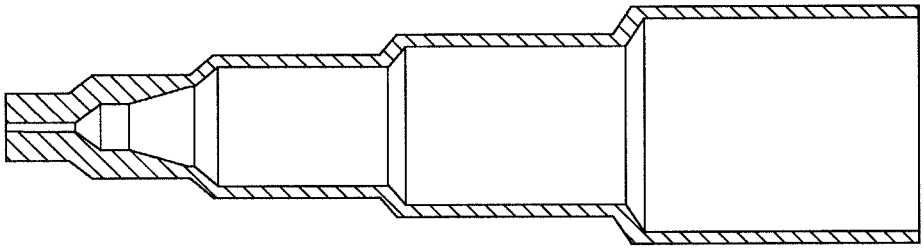
FIG.12D THICKNESS DEVIATION PROCESS AT DISTAL PART
: COMPARATIVE EXAMPLE B
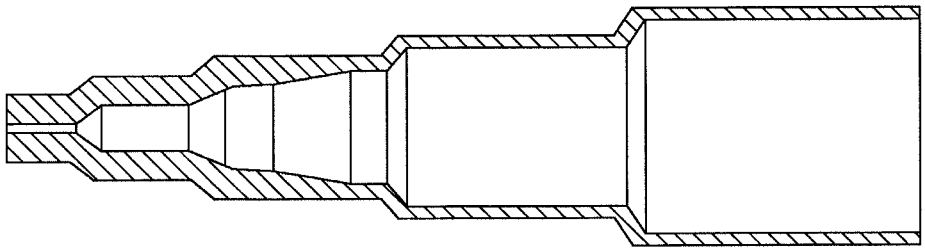

FIG.14

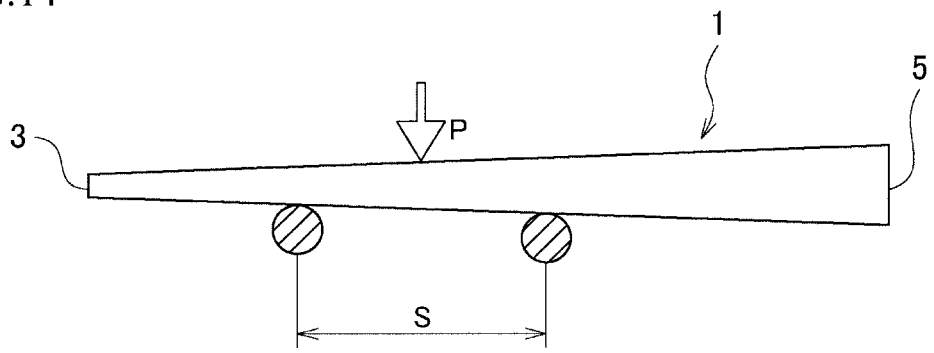

FIG.15

| SHAFT | | A1 | A2 | A3 | A2/A1 | A2/A3 |
|---|---|---|---|---|---|---|
| A1 : 0～200mm<br>A2 : 200～600mm<br>A3 : 600mm～ | COMPARATIVE EXAMPLE A | $3.72 \times 10^6$ | $5.88 \times 10^6$ | $9.07 \times 10^6$ | 158.1% | 64.8% |
| | EMBODIMENT | $3.33 \times 10^6$ | $7.05 \times 10^6$ | $9.27 \times 10^6$ | 211.7% | 76.0% |
| | COMPARATIVE EXAMPLE B | $3.82 \times 10^6$ | $5.63 \times 10^6$ | $8.79 \times 10^6$ | 147.6% | 64.1% |

FIG.16

| | "+" REPRESENTING RIGIDITY IMPROVEMENT RELATIVE TO COMPARATIVE EXAMPLE A | |
|---|---|---|
| | INTERMEDIATE PART /DISTAL PART | INTERMEDIATE PART /GRIP |
| EMBODIMENT | 53.5% | 11.2% |
| COMPARATIVE EXAMPLE B | −10.5% | −0.7% |

SHAFT FOR GOLF CLUB HAVING RIGIDITY IMPROVED AT INTERMEDIATE PART

BACKGROUND OF THE INVENTION

1. Field of the Invention

The present invention relates to a shaft for a golf club having a rigidity improved at an intermediate part.

2. Description of Related Art

A golf club is generally required to have a capability to hit a ball a longer distance. For this, it is important to hit a higher ball and reduce spin on the ball that causes air resistance.

Japanese Unexamined Patent Application Publication No. H10-216280 discloses a golf club having a shaft with a non-circular section in a given region between a distal part to a proximal part. The non-circular section has a long diameter "L" and a short diameter "S" that are set within a given ratio range. The short diameter "S" is parallel to a perpendicular line passing through a center of a face of a clubhead.

The golf club realizes an adjusted kickpoint capable of hitting a higher ball.

With the mere adjusted kickpoint, it cannot hit a ball a longer distance because a spin on the ball is not reduced.

SUMMARY OF THE INVENTION

An object of the present invention is to provide a shaft for a golf club capable of hitting a higher ball and reducing spin on the ball for a longer distance.

In order to accomplish the object, an aspect of the present invention provides a shaft for a golf club that includes a distal part that is provided with a clubhead, a proximal part that is provided with a grip, an intermediate part arranged between the distal and proximal parts, and a thick part set to thicken a wall thickness of the intermediate part relative to the distal part, a reinforcing part set at the intermediate part, or a combination of the thick part and the reinforcing part. With the thick part, reinforcing part or the combination thereof, it improves a rigidity at the intermediate part so that a change in rigidity between the distal part and the intermediate part has an inflection point.

This aspect of the present invention can hit a higher ball and reduce spin on the ball for a longer distance.

BRIEF DESCRIPTION OF THE DRAWINGS

FIGS. 10A and 10B are longitudinal sectional views in which FIG. 10A illustrates a reference stepped shaft without a thick part and FIG. 10B illustrates the stepped shaft with the thick part according to the eighth embodiment;

FIGS. 11A to 11C are longitudinal sectional views illustrating a process for manufacturing the stepped shaft according to the eighth embodiment, in which FIG. 11A is a straight material tube, FIG. 11B is a partly-thickened material tube after a thickness deviation process, and FIG. 11C is the stepped shaft after a stepping process;

FIGS. 12A to 12D are longitudinal sectional views illustrating stepped shafts in which FIG. 12A is a reference example with no thick part to be formed through a thickness deviation process, FIG. 12B is the eighth embodiment with the thick part formed through the thickness deviation process, FIG. 12C is a comparative example A with a thick part formed at a distal part through a thickness deviation process, and FIG. 12D is a comparative example B with a thick part longer than the comparative example A.

FIG. 14 is a schematic view illustrating a method for measuring rigidity of an objective shaft according to an embodiment;

FIG. 15 is a table illustrating longitudinal changes in rigidity according to the eighth embodiment, comparative example A, and comparative example B;

FIG. 16 is a table illustrating improvement rates in rigidity for the intermediate parts according to the eighth embodiment and the comparative example B relative to the comparative example A;

DETAILED DESCRIPTION OF EMBODIMENTS

Embodiments of the present invention will be explained. Each embodiment realizes a shaft for a golf club capable of hitting a higher ball and reducing spin on the ball. For this, the shaft of each embodiment includes a distal part that is provided with a clubhead, a proximal part that is provided with a grip, an intermediate part arranged between the distal and proximal parts, and a thick part set to thicken a wall thickness of the intermediate part relative to the distal part, a reinforcing part set at the intermediate part, or a combination of the thick part and the reinforcing part. The thick part, reinforcing part or the combination thereof improves a rigidity at the intermediate part so that a change in rigidity between the distal part and the intermediate part has an inflection point.

Figure 1:
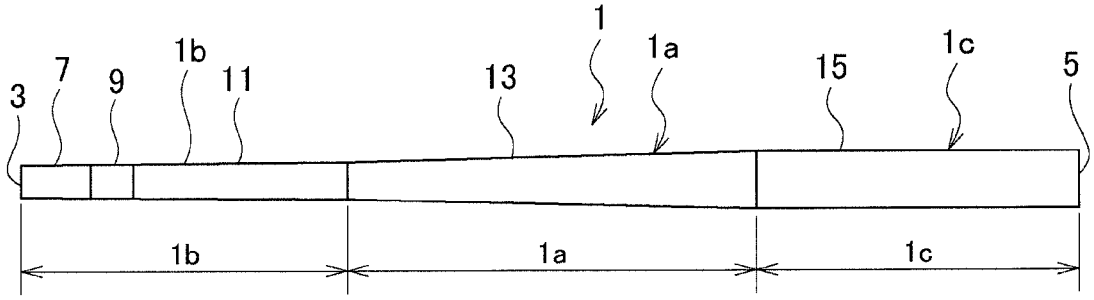
FIG. 1 is a general view illustrating a shaft for a golf club without a clubhead and a grip.

The present invention will be explained in detail with reference to FIGS. 1 and 2. FIG. 1 is a general view illustrating a shaft 1 for a golf club without a clubhead and a grip.

As illustrated in FIG. 1, the shaft 1 is used as a main body for a golf shaft and includes a distal part 1*b*, an intermediate part 1*a*, and a proximal part 1*c*. The distal part 1*b* extends from a distal end 3 to one end of the intermediate part 1*a* and is provided with a clubhead (not illustrated). The proximal part 1*c* extends from a proximal end 5 to the other end of the intermediate part 1*a* and is provided with a grip (not illustrated). The intermediate part 1*a* is arranged between the distal part 1*b* and the proximal part 1*c*.

According to the embodiment, the shaft 1 is made of, for example, a steel tubular shaft with a circular cross section. From the distal end 3, a distal straight tube part 7, a distal tapered tube part 9, an intermediate straight tube part 11, an intermediate tapered tube part 13 and a proximal straight tube part 15 are longitudinally continuously connected in this order. The shaft 1 is not limited to the circular cross section. Therefore, the cross section of the shaft 1 may be an arbitrary shape such as ellipse. Also, one or more tube parts for the shaft 1 may be arbitrarily selected or combined. For example, the shaft 1 may be made of an entirely-tapered tube or of a tube having a part with a diametrically-enlarged cross section relative to the other part. The material of the shaft 1 is not limited to steel and may be fiber-reinforced plastic or the like.

Figure 2:
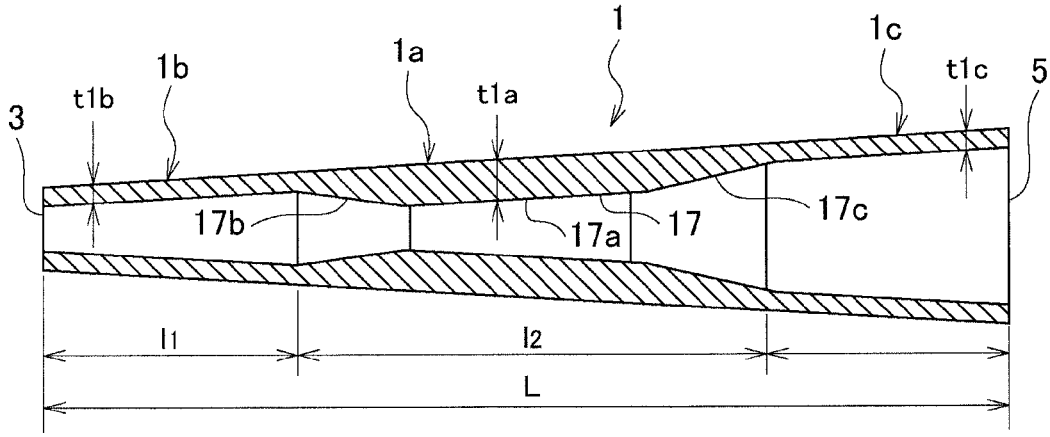
FIG. 2 is a longitudinal sectional view schematically illustrating a shaft with a thick part for a golf club without a clubhead and a grip according to a first embodiment of the present invention.

FIG. 2 discloses an embodiment of the invention in which like parts with respect to the FIG. 1 embodiment are given the same reference numbers and provide the same functions. FIG. 2 is a longitudinal sectional view schematically illustrating the shaft 1 with a thick part 17.

In FIG. 2, the shaft 1 is a schematic example that is an entirely-tapered tube made of steel or fiber-reinforced plastic. The entirely-tapered tube has an inclined external surface with a constant inclined angle. The shaft 1 has the thick part 17 at the intermediate part 1*a*. The thick part 17 thickens a wall thickness as a single layer relative to the distal part 1*b* and the proximal part (grip) 1*c* that are standard parts of the shaft 1. With the thick part 17, a rigidity at the intermediate part 1*a* is improved so that a change in rigidity between the distal part 1*b* and the intermediate part 1*a* has an inflection point.

According to the embodiment, the thick part 17 is set within only the intermediate part 1*a*. However, the proximal part 1*c* may also have a thick part or thickened wall thickness as well as the thick part 17.

Figure 13:
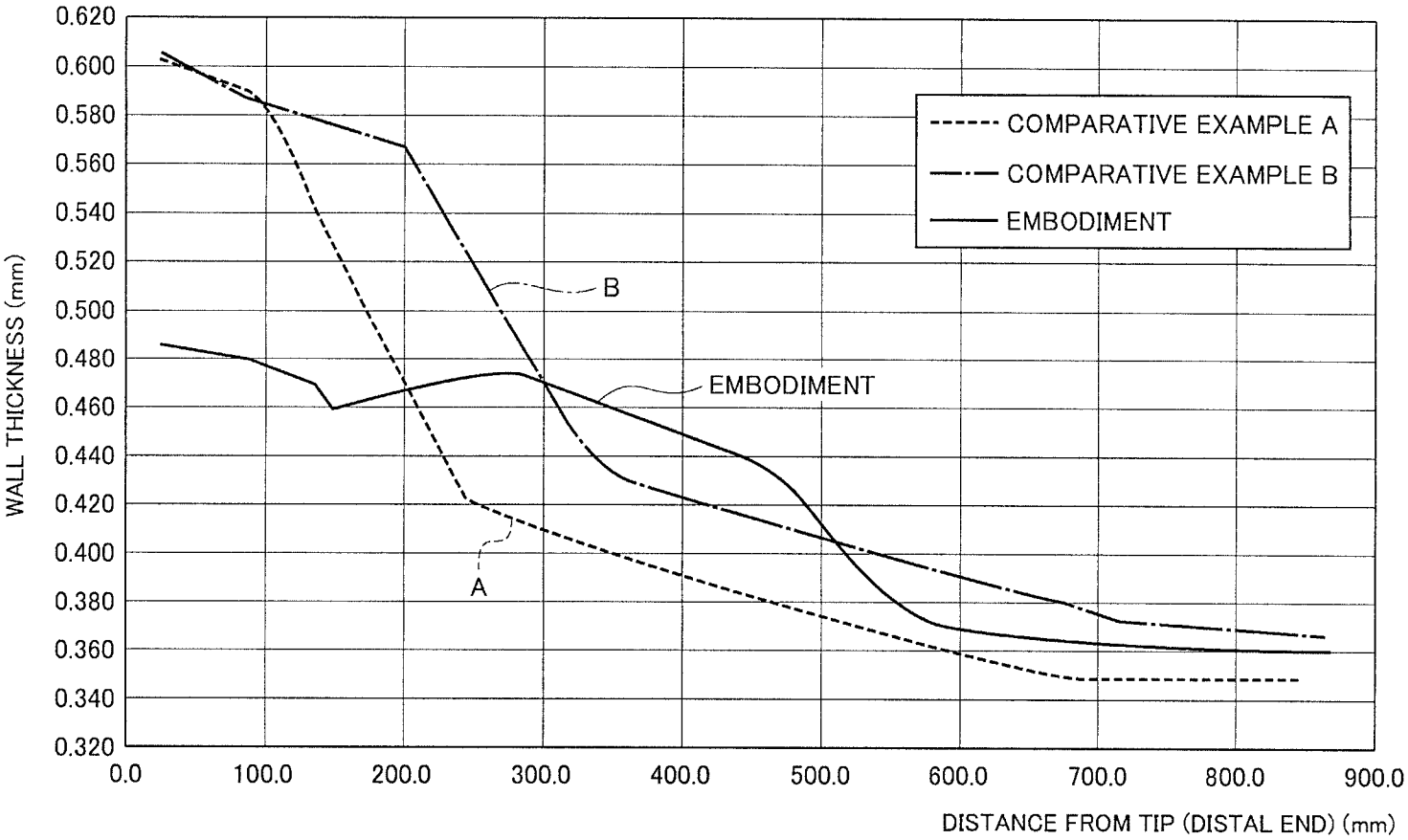
FIG. 13 is a graph illustrating longitudinal changes in wall thickness according to the eighth embodiment, comparative example A, and comparative example B.

The thick part 17 of the shaft 1 is formed to bulge inward from an inner periphery of the shaft 1. The wall thickness of the shaft 1 including the thick part 17 has a general form in which the distal part 1*b* is relatively thick and the proximal part 1*c* on the grip side is relatively thin as a segment of "EMBODIMENT" illustrated in FIG. 13, for example. The wall thickness of the intermediate part 1*a* is set to gradually change as illustrated in FIG. 13 along the general form of the shaft 1 and defines a tapered hole 17*a* inside the thick part 17. At respective longitudinal end portions of the thick part 17, tapered holes 17*b* and 17*c* are formed, respectively. With the tapered holes 17*b* and 17*c*, the thick part 17 gradually reduces in wall thickness toward both ends of the thick part 17.

The tapered holes 17*b* and 17*c* function as transition portions that prevent the sectional shape of the shaft 1 from steeply changing. This suppresses generation of partial high stress due to deformation of the shaft 1 when hitting a ball, to improve durability of the golf club with the shaft 1 and prevent the shaft 1 from breaking while in use. In addition to that, the shaft 1 naturally smoothly whips in continuity, to secure characteristics that the change in rigidity between the distal part 1*b* and the intermediate part 1*a* has the inflection point due to the improvement of the rigidity at the intermediate part 1*a*.

As a method of manufacturing the shaft 1 made of steel, for example, a plate material is rolled to form a shaft material tube, and then, a thickness deviation process is carried out to the shaft material tube by forging with use of a core member to control a formation of the thick part 17. However, the method for manufacturing the shaft 1 is not limited to the above.

A product as a golf club having the shaft 1 according to the embodiment is confirmed to provide a high launch angle and a low spin on a ball relative to a conventional golf club, as a result of trial hittings with use of the golf club having the shaft 1 and the conventional golf club. The trial hitting for the golf club with the shaft 1 is carried out by a swinging robot to hit a ball under the same condition as the conventional golf club. The conventional golf club has no configuration to improve the rigidity at an intermediate part 1*a* so that a change in rigidity between a distal part and the intermediate part has the inflection point unlike the first embodiment. In this way, the embodiment allows the golf club to hit a higher ball and reduce spin on the ball.

In a case where the shaft 1 is a carbon shaft made of fiber-reinforced plastic (prepreg), the rigidity of the intermediate part 1*a* may be improved relative to the distal part 1*b* or both the distal part 1*b* and the proximal part 1*c* by setting a reinforcing part instead of the thick part 17. The reinforcing part may be set by adjusting a rigidity of the prepreg as itself or adjusting a fiber direction of each layer of the prepreg that is wound in a tube. The adjustment of the fiber direction may cross a fiber direction of a layer with a fiber direction of an adjoining layer, for example.

As a method of manufacturing the shaft 1 made of fiber-reinforced plastic and having the longitudinal sectional shape with the thick part 17 as illustrated in FIG. 2, a core bar may be used. The core bar has a narrow portion at a longitudinal intermediate part to have an external shape according to the inner periphery of the shaft 1 of FIG. 2. Additionally, the core bar includes two members longitudinally separably connected at the intermediate part. On the core bar, the prepreg is layered so that the number of layers is changed at the intermediate part relative to the other parts. With this, the carbon shaft 1 made of fiber-reinforced plastic has the longitudinal sectional shape with the thick part 17 as illustrated in FIG. 2. After forming the carbon shaft 1 on the core bar, the core bar is longitudinally separated at the intermediate part and the separated two members are pulled out of respective ends of the carbon shaft 1.

A second embodiment of the present invention will be explained in detail with reference to FIG. 3 which is a longitudinal sectional view schematically illustrating a shaft 1A with a thick part 17A and a reinforcing member 19 as a reinforcing part. The second embodiment has a basic structure that is the same as that of the first embodiment. Therefore, elements of FIG. 3 corresponding to those of the first embodiment of FIG. 2 are represented with the same reference numerals or the same reference numerals plus "A" to omit repetition.

Figure 3:
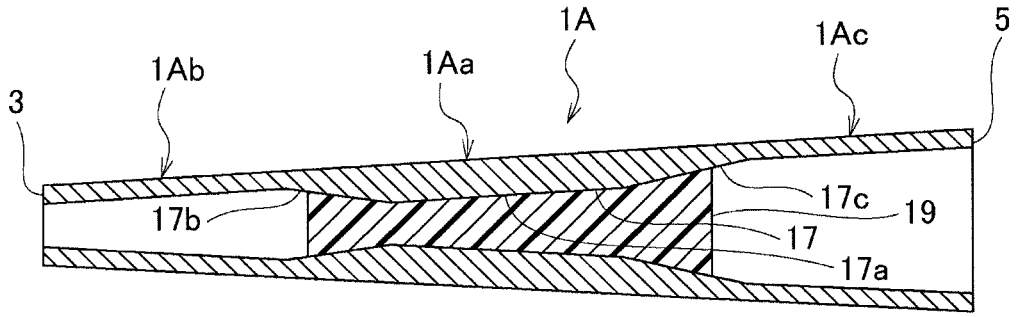
FIG. 3 is a longitudinal sectional view schematically illustrating a shaft with a thick part and a reinforcing part according to a second embodiment of the present invention.

As illustrated in FIG. 3, the shaft 1A made of steel or fiber-reinforced plastic has the additional reinforcing member 19 on the basis of the structure of the first embodiment illustrated in FIG. 2. Due to the reinforcing member 19, a reinforcing part is set at an intermediate part 1Aa of the shaft 1A. With both the thick part 17 and the reinforcing member 19, the second embodiment improves a rigidity at the intermediate part 1Aa so that a change in rigidity between a distal part 1Ab and the intermediate part 1Aa has an inflection point.

The reinforcing member 19 is a rod member fitted to an inner periphery of the shaft 1A, to entirely cover the thick part 17. Namely, the reinforcing member 19 has a tapered external shape to fit a tapered hole 17*a* defined by the thick part 17.

The reinforcing member 19 longitudinally extends so that longitudinal ends of the reinforcing member 19 are positioned at the middles of the tapered holes 17*b* and 17*c*, respectively. However, the reinforcing member 19 may be longer or shorter. Namely, the ends of the reinforcing member 19 may be positioned at boundaries between the tapered hole 17*b* and the distal part 1Ab and between the tapered hole 17*c* and a proximal part 1Ac, respectively. Further, the ends of the reinforcing member 19 may be positioned longitudinally inside the tapered holes 17*b* and 17*c*.

The reinforcing member 19 is made of wide variety of materials, for example, FRP (fiber-reinforced plastic) such as carbon fiber or glass fiber, resin such as urethane or rubber, cloth impregnated with resin or adhesive, or the like. For fixing the reinforcing member 19, adhesion or the like may be applied.

A third embodiment of the present invention will be explained in detail with reference to FIG. 4 which is a longitudinal sectional view schematically illustrating a shaft 1B with a thick part 17B. The third embodiment has a basic structure that is the same as that of the first embodiment. Therefore, elements of FIG. 4 corresponding to those of the first embodiment of FIG. 2 are represented with the same reference numerals or the same reference numerals plus "B" to omit repetition.

Figure 4:
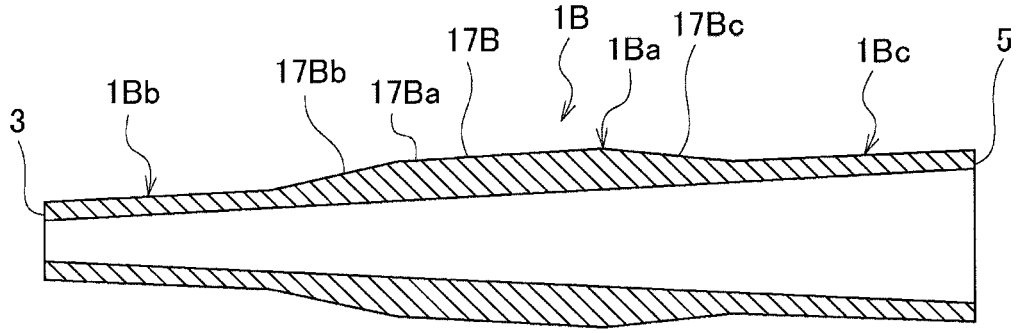
FIG. 4 is a longitudinal sectional view schematically illustrating a shaft with a thick part according to a third embodiment of the present invention.

As illustrated in FIG. 4, the shaft 1B has the thick part 17B that is formed to bulge outward from an outer periphery of the shaft 1B at an intermediate part 1Ba instead of the thick part 17 of the first embodiment that is formed to bulge inward from the inner periphery.

As a method of manufacturing the shaft 1B made of steel, a thickness deviation process may be carried out to a shaft material tube by forging to control a formation of the thick part 17B. As a result, the shaft 1B is manufactured to have the thick part 17B bulging outward from the outer periphery. The method for manufacturing the shaft 1B is not limited to the above.

As a method of manufacturing the shaft 1B made of fiber-reinforced plastic, a prepreg may be layered on a core bar so that the number of layers is changed at an intermediate part of the core bar relative to the other parts. With this, the shaft 1B is manufactured to have the longitudinal sectional shape with the thick part 17B as illustrated in FIG. 4.

The wall thickness of the shaft 1B including the thick part 17B longitudinally changes similar to the general form illustrated as the segment of "EMBODIMENT" in FIG. 13.

In this way, the third embodiment improves a rigidity at the intermediate part 1Ba relative to the distal part 1Bb and the proximal part 1Bc, thereby allowing a golf club with the shaft 1B to hit a higher ball and reduce spin on the ball like the first embodiment.

A fourth embodiment of the present invention will be explained in detail with reference to FIG. 5 which is a longitudinal sectional view schematically illustrating a shaft 1C with a reinforcing part 19C as a reinforcing part. The fourth embodiment has a basic structure that is the same as the third embodiment. Therefore, elements of FIG. 5 corresponding to those of the third embodiment of FIG. 4 are represented with the same reference numerals or the same reference numerals plus "C" to omit repetition.

Figure 5:
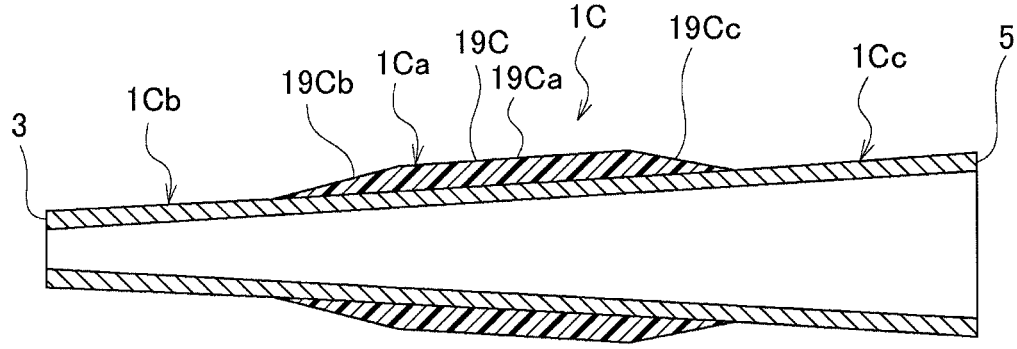
FIG. 5 is a longitudinal sectional view schematically illustrating a shaft with a reinforcing part according to a fourth embodiment of the present invention.

As illustrated in FIG. 5, the shaft 1C made of steel or fiber-reinforced plastic is a simply-tapered basic shaft to which the reinforcing member 19C is fitted. Due to the reinforcing member 19C, a reinforcing part is set at an intermediate part 1Ca of the shaft 1C, instead of the formation of the thick part 17B of the third embodiment illustrated in FIG. 4 that thickens the wall thickness as the single layer at the intermediate part 1Ba relative to the other parts. The reinforcing member 19C sets a rigidity at the intermediate part 1Ca of the shaft 1C.

The tapered basic shaft for the shaft 1C has a wall thickness along the general form in which a distal part 1Cb is relatively thick and a proximal part 1Cc on a grip side is relatively thin as the segment of "EMBODIMENT" in FIG. 13. Unlike FIG. 13, the tapered basic shaft for fitting the reinforcing member 19C has no thick part at the intermediate part 1 Ca and a continuous change in wall thickness with an approximate constant rate.

The reinforcing member 19C is made of wide variety of materials, for example, FRP such as carbon fiber or glass fiber, resin such as urethane or rubber, cloth impregnated with resin or adhesive, metal such as steel, aluminum, aluminum alloy, titanium, titanium alloy, copper, copper alloy or the like. For fixing the reinforcing member 19C, adhesion, press fitting, welding or the like may be applied.

According to the fourth embodiment, the reinforcing member 19C is made of carbon fiber and has an annular shape. The reinforcing member 19C is fitted to an outer periphery at the intermediate part of the tapered basic shaft made of steel or fiber-reinforced plastic.

In this way, the fourth embodiment improves a rigidity at the intermediate part 1Ca relative to the distal part 1Cb and the proximal part 1Cc, thereby allowing a golf club with the shaft 1C to hit a higher ball and reduce spin on the ball like the first or third embodiment.

In addition, the reinforcing member 19C is applicable to the intermediate part 1*a* of the shaft 1 of FIG. 2. In this case, the reinforcing member 19C fits to the outer periphery of the shaft 1 longitudinally corresponding to the bulged thick part 17.

Further, the reinforcing member 19C is also applicable to the intermediate part 1Ba of the shaft 1B of FIG. 4. In this case, the reinforcing member 19C fits to the thick part 17B that bulges outward from the outer periphery of the shaft 1B.

A fifth embodiment of the present invention will be explained in detail with reference to FIG. 6 which is a longitudinal sectional view schematically illustrating a shaft 1D with a thick part 17D. The fifth embodiment has a basic structure that is the same as the first embodiment. Therefore, elements of FIG. 6 corresponding to those of the first embodiment of FIG. 2 are represented with the same reference numerals or the same reference numerals plus "D" to omit repetition.

Figure 6:
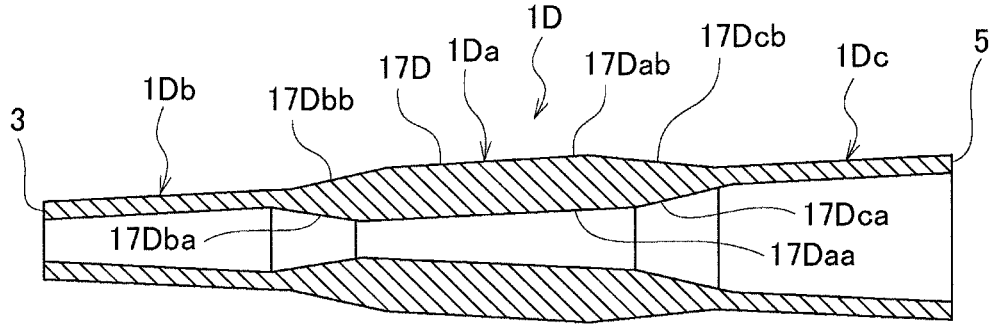
FIG. 6 is a longitudinal sectional view schematically illustrating a shaft with a thick part according to a fifth embodiment of the present invention.

As illustrated in FIG. 6, the shaft 1D that is made of steel or fiber-reinforced plastic has the thick part 17D so as to bulge outward and inward from an outer periphery and an inner periphery of the shaft 1D.

In a case where the shaft 1D is made of steel, the shaft 1D may be shaped through a thickness deviation process such as forging. In a case where the shaft 1D is made of fiber-reinforced plastic, the shaft 1D may be manufactured by a combination of the methods explained in the first and forth embodiments with reference to FIGS. 2 and 4.

The wall thickness of the shaft 1D including the thick part 17D longitudinally changes similar to the general form as the segment of "EMBODIMENT" in FIG. 13 like the first embodiment. At an intermediate part 1Da, the shaft 1D is thicker than the first embodiment due to the thick part 17D.

In this way, the fifth embodiment improves a rigidity at the intermediate part 1Da relative to a distal part 1Db and a proximal part 1Dc, thereby allowing a golf club with the shaft 1D to hit a higher ball and reduce spin on the ball like the first embodiment.

Incidentally, tapered holes 17Daa, 17Dba and 17Dca correspond to the respective tapered holes 17*a*, 17*b* and 17*c* of FIG. 2 and tapered portions 17Dab, 17Dbb and 17Dcb correspond to the respective tapered portions 17Ba, 17Bb and 17Bc of FIG. 4.

Figure 7A:
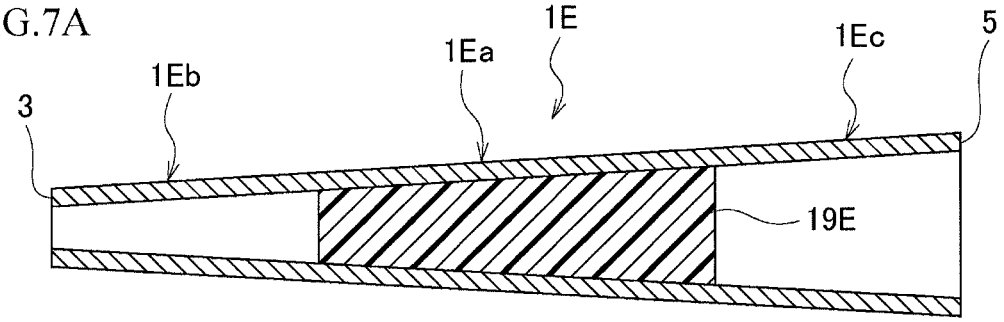
FIGS. 7A and 7B are longitudinal sectional views in which FIG. 7A schematically illustrates a shaft with a reinforcing part according to a sixth embodiment of the present invention and FIG. 7B schematically illustrates a modification of the reinforcing part.
Figure 7B:
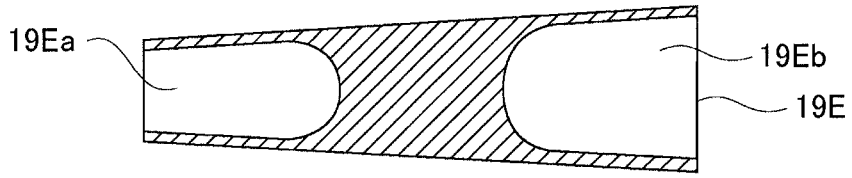

A sixth embodiment of the present invention will be explained in detail with reference to FIGS. 7A and 7B. FIGS. 7A and 7B are longitudinal sectional views in which FIG. 7A schematically illustrates a shaft 1E with a reinforcing part 19E as a reinforcing part according to the sixth embodiment of the present invention and FIG. 7B schematically illustrates a modification of the reinforcing part 19E. The sixth embodiment has a basic structure that is the same as the first embodiment. Therefore, elements of FIGS. 7A and 7B corresponding to those of the first embodiment of FIG. 2 are represented with the same reference numerals or the same reference numerals plus "E" to omit repetition.

As illustrated in FIG. 7A, the shaft 1E made of steel or fiber-reinforced plastic is a simply-tapered basic shaft into which the reinforcing member 19E is fitted at an intermediate part 1Ea. Due to the reinforcing member 19E, a reinforcing part is set at the intermediate part 1Ea of the shaft 1E. The tapered basic shaft is the same as that of FIG. 5.

The reinforcing member 19E is made of wide variety of materials, for example, FRP such as carbon fiber or glass fiber, resin such as urethane or rubber, cloth impregnated with resin or adhesive, metal such as steel, aluminum, aluminum alloy, titanium, titanium alloy, copper, copper alloy or the like. For fixing the reinforcing member 19E, adhesion, press fitting, welding or the like may be applied.

In a case where the reinforcing member 19E is made of FRP such as carbon fiber or glass fiber, resin such as urethane or rubber, or cloth impregnated with resin or adhesive, the reinforcing member 19E may have a circular truncated cone shape as illustrated in FIG. 7A. The reinforcing member 19E has no transition portions that prevent the sectional shape of the reinforcing member 19E from steeply changing like the tapered holes 17*b* and 17*c*. Even this structure suppresses generation of partial high stress at each end of the reinforcing member 19E. However, the reinforcing member 19E may also have transition portions as illustrated in FIG. 7B.

In a case where the reinforcing member 19E is made of metal such as steel, aluminum, aluminum alloy, titanium, titanium alloy, copper, copper alloy or the like, the reinforcing member 19E may be provided with bored portions 19Ea and 19Eb at respective ends, to define transition portions.

In this way, the sixth embodiment improves a rigidity at the intermediate part 1Ea relative to a distal part 1Eb and a proximal part 1Ec, thereby allowing a golf club with the shaft 1E to hit a higher ball and reduce spin on the ball like the first embodiment.

In addition, the reinforcing member 19E is applicable to the intermediate part 1Ba of the shaft 1B of FIG. 4. In this case, the reinforcing member 19E fits to the inner periphery of the shaft 1B longitudinally corresponding to the bulged thick part 17B.

A seventh embodiment of the present invention will be explained in detail with reference to FIG. 8 which is a longitudinal sectional view schematically illustrating a shaft 1F with a reinforcing part 19F as a reinforcing part. The seventh embodiment has a basic structure that is the same as the first embodiment. Therefore, elements of FIG. 8 corresponding to those of the first embodiment of FIG. 2 are represented with the same reference numerals or the same reference numerals plus "F" to omit repetition.

Figure 8:
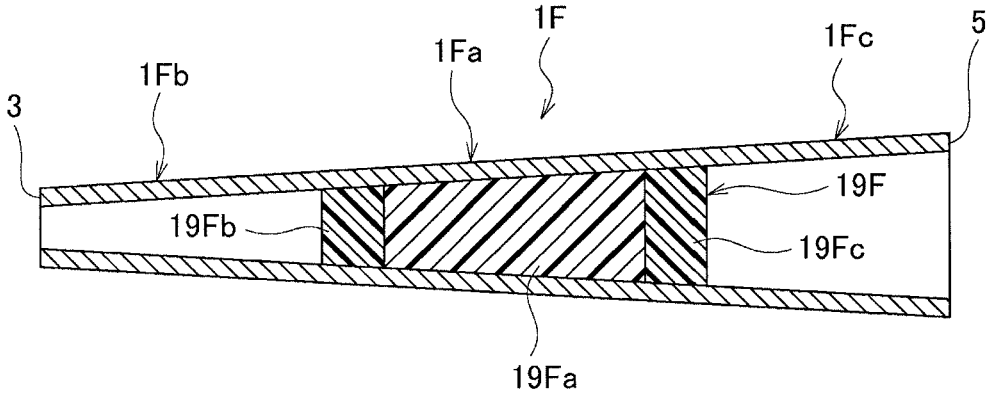
FIG. 8 is a longitudinal sectional view schematically illustrating a shaft with a reinforcing part according to a seventh embodiment of the present invention.

As illustrated in FIG. 8, the shaft 1F made of steel or fiber-reinforced plastic is a simply-tapered basic shaft into which the reinforcing member 19F is fitted at an intermediate part 1Fa. Due to the reinforcing member 19F, a reinforcing part is set at the intermediate part 1Fa of the shaft 1F The basic shaft is the same as that of FIG. 5.

The reinforcing member 19F is made of wide variety of materials, for example, FRP (fiber-reinforced plastic) such as carbon fiber or glass fiber, resin such as urethane or rubber, cloth impregnated with resin or adhesive, metal such as steel, aluminum, aluminum alloy, titanium, titanium alloy, copper, copper alloy or the like. For fixing the reinforcing member 19E, adhesion, press fitting, welding or the like may be applied.

The reinforcing member 19F includes a reinforcing middle member 19Fa and reinforcing end members 19Fb and 19Fc. The reinforcing middle member 19Fa and reinforcing end members 19Fb and 19Fc are arranged side by side in a longitudinal direction of the shaft 1F and made of different materials. According to the embodiment, the reinforcing middle member 19Fa is made of FRP and the reinforcing end members 19Fb and 19Fc are made of resin such as rubber.

In this way, the seventh embodiment improves a rigidity at the intermediate part 1Fa relative to a distal part 1Fb and a proximal part 1Fc, thereby allowing a golf club with the shaft 1F to hit a higher ball and reduce spin on the ball like the first embodiment.

The structure of the reinforcing member 19F in which plural reinforcing members are longitudinally arranged side by side and made of different materials is applicable to the second and sixth embodiment illustrated in FIGS. 3 and 7.

Figure 9A:
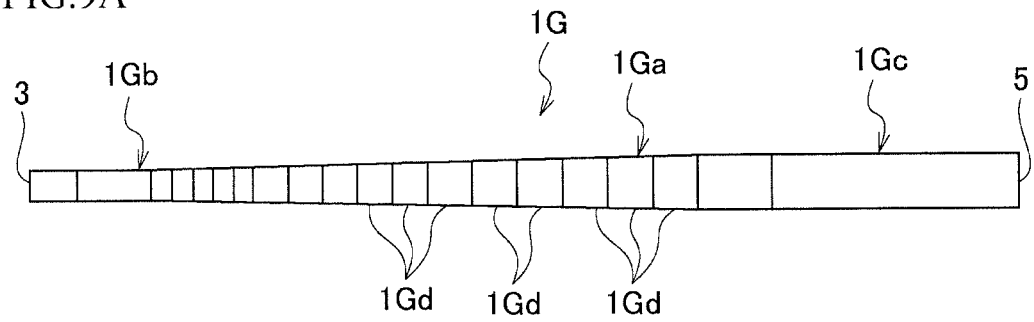
FIG. 9A is a general view illustrating a stepped shaft for a golf club without a clubhead and a grip according to an eighth embodiment of the present invention and FIG. 9B is a view partly illustrating the stepped shaft of FIG. 9A.
Figure 9B:
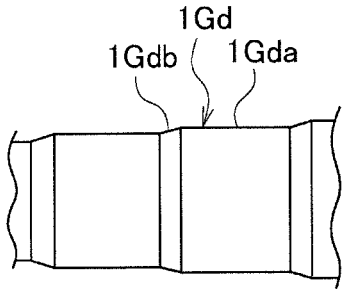
Figure 10A:
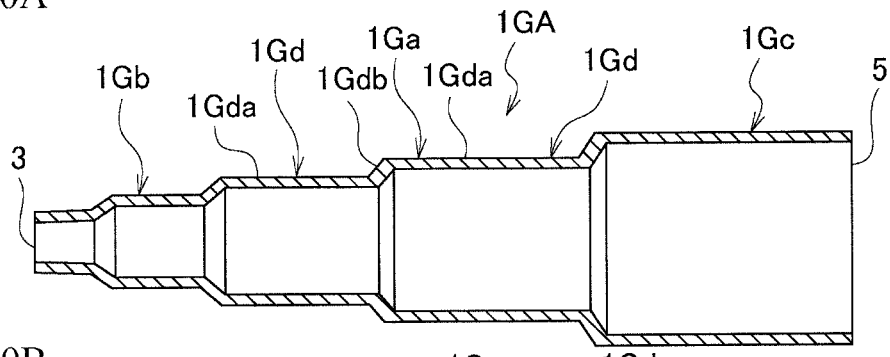
Figure 10B:
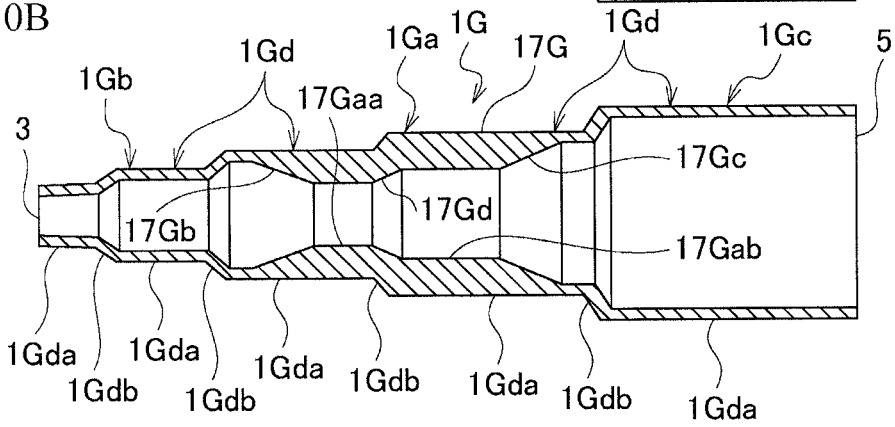

An eighth embodiment of the present invention will be explained in detail with reference to FIGS. 9A to 22. FIG. 9A is a general view illustrating a stepped shaft 1G for a golf club without a clubhead and a grip according to the eighth embodiment, FIG. 9B is a view partly illustrating the stepped shaft 1G of FIG. 9A, FIG. 10A is a longitudinal sectional view illustrating a reference stepped shaft without a thick part, and FIG. 10B is a longitudinal sectional view illustrating the stepped shaft 1G with a thick part 17G according to the eighth embodiment. The eighth embodiment has a basic structure that is the same as the first embodiment. Therefore, elements of FIGS. 9A to 10B corresponding to those of the first embodiment of FIG. 2 are represented with the same reference numerals or the same reference numerals plus "G" to omit repetition.

As illustrated in FIGS. 9A and 9B, the shaft 1G that is made of steel according to the eighth embodiment has stepped outer and inner shapes. Each step 1Gd includes a flat portion 1Gda defined by a straight tube part and a tapered portion 1Gdb defined by a tapered tube part. The stepped shaft 1G has the thick part 17G that is formed to bulge inward from an inner periphery of the shaft 1G.

Namely, the thick part 17G is added to a shape of the reference stepped shaft of FIG. 10A at an intermediate part 10Ga, to form the stepped shaft 1G of FIG. 10B.

The thick part 17G longitudinally spans, for example, two steps 1Gd to define straight holes 17Gaa and 17Gab and tapered holes 17Gb, 17Gc and 17Gd inside. The straight hole 17Gaa has a smaller diameter than that of the straight hole 17Gab, to gradually change the wall thickness of the thick part 17G similar to the general form of FIG. 13. The tapered holes 17Gb and 17Gc are positioned at longitudinal end portions of the thick part 17G and inside the flat portions 1Gda of the two steps 1Gd, respectively. The tapered hole 17Gd between the straight holes 17Gaa and 17Gab is positioned in the middle of the thick part 17G and inside the tapered portion 1Gdb between the two steps 1Gd.

A method of manufacturing the stepped shaft 1G will be explained in detail with reference to FIGS. 11A to 11C. FIGS. 11A to 11C are longitudinal sectional views illustrating a process for manufacturing the stepped shaft 1G, in which FIG. 11A is a straight material tube 111G, FIG. 11B is a partly-thickened material tube 11G after a thickness deviation process, and FIG. 11C is the stepped shaft 1G after a stepping process.

As illustrated in FIG. 11A to 11C, the method includes three process steps. The first process step rolls a plate material to form the shaft material tube 111G (FIG. 11A), for example. The second process step carries out a thickness deviation process to the shaft material tube 111G by, for example, forging with use of a core member to control a formation of a thickened part 117G (FIG. 11B). This forms a partly-thickened material tube 11G. The third process step carries out a tapering process to the partly-thickened material tube 11G to form a tapered material tube as illustrated in FIG. 2. This forms a tapered material tube. Thereafter, the third process step carries out a stepping process to the tapered material tube with use of a stepping process machine to form the stepped shaft 1G (FIG. 11C).

In this way, the method manufactures the stepped shaft 1G with the thick part 17G at the intermediate part 1Ga.

In the method, after the thickness deviation process and before the stepping process, it forms the tapered material tube having the thickened part to be shaped into the thick part 17G and having a longitudinal sectional shape similar to the shaft 1 of FIG. 2. In order to finally shape the tapered material tube into the shaft 1G with the thick part 1G at the intermediate part 1Ga, the tapered material tube is formed to satisfy following conditions of:

$$t1b \text{ times } 1.05 < t1a < t1b \text{ times } 1.40;$$

$$l1 < L \text{ times } 0.30; \text{ and}$$

$$l2 < L \text{ times } 0.75 - l1.$$

In the conditions, with reference to FIG. 2 for numerals, "L" is an entire length between distal and proximal ends of the tapered material tube (1), "l1" is a length between the distal end (3) and one end of the thickened part (17), "l2" is a length of the thickened part (17), "t1a" is a wall thickness of the thickened part (17) and "t1b" is a wall thickness of a distal part (1*b*) of the tapered material tube (1).

With the conditions, the stepped shaft 1G of FIG. 11C after the stepping process is confirmed to have a rigidity on target.

In addition to the conditions, the tapered material tube (1) may satisfy a following condition:

$$t1c \text{ times } 1.05 < t1a < t1c \text{ times } 1.40.$$

In the condition, with reference to FIG. 2, "t1c" is a wall thickness of a proximal part (1*c*) of the tapered material tube (1).

By addition of this condition, the stepped shaft 1G of FIG. 11C after the stepping process is confirmed to have a more preferable rigidity on target.

Results of comparison between the stepped shaft 1G and comparative examples A and B will be explained. FIGS. 12A to 12D are longitudinal sectional views illustrating stepped shafts of a reference example, the eighth embodiment, the comparative example A and the comparative example B, respectively. The reference example has no thick part to be formed through a thickness deviation process. The eighth embodiment has the thick part 17G formed through the thickness deviation process. The comparative example A has a thick part formed at a distal part through a thickness deviation process. The comparative example B has a thick part longer than the comparative example A.

FIG. 13 is a graph illustrating longitudinal changes in wall thickness of the stepped shafts according to the eighth embodiment, comparative example A, and comparative example B. Each longitudinal change in wall thickness is a change from the distal part through the intermediate part to the proximal part. For the comparison, the stepped shaft 1G according to the eighth embodiment is formed by carrying out the stepping process to the tapered material tube that satisfies the aforementioned conditions.

As illustrated in FIGS. 12C, 12D and 13, the stepped shafts of the comparative examples A and B each have a thick part at the distal part and no thick part at the intermediate part. Therefore, each comparative example does not improve a rigidity at the intermediate part of the stepped shaft. In contrast, the stepped shaft 1G of the eighth embodiment has the thick part 17G at the intermediate part 1Ga relative to the other parts.

FIG. 14 is a schematic view illustrating a method for measuring a rigidity of an objective shaft.

As illustrated in FIG. 14, just like the three point bending, the objective shaft is supported at two support points (span S=300 mm), a load P is applied between the two support points to bend the objective shaft so that the bending becomes a predetermined amount (δ=2 mm), and the value of the load P is measured at the predetermined amount of the bending. This measurement is carried out over the entire length of the objective shaft. The rigidity of the objective shaft is calculated by a following equation on the basis of the load and the bending.

$$EI=(1/48)(PL^3)/\delta$$

With the method of FIG. 14, the eighth embodiment obtains rigidities of the stepped shafts as objective shafts according to the eighth embodiment, comparative example A, and comparative example B as illustrated in FIGS. 15 and 16.

FIG. 15 is a table illustrating longitudinal changes in rigidity according to the eighth embodiment, comparative example A, and comparative example B. FIG. 16 is a table illustrating improvement rates in rigidity for the intermediate parts according to the eighth embodiment and the comparative example B relative to the comparative example A.

In FIG. 15, "A1" represents a region (0-200 mm) as a distal part from a distal end to one of the support points (left support point of FIG. 14), "A2" represents a region (200-600 mm) as an intermediate part between the support points, and "A3"

represents a region (600 mm-) as a proximal part from the other of the support points (right support point of FIG. 14) to a proximal end. In the case of FIG. 15, the entire length is 900 mm.

As a rigidity measurement, a rigidity distribution is measured while the support points are shifted right and left little by little relative to each region of each stepped shaft.

FIG. 15 represents a value of each region of the eight embodiment and the comparative examples A and B. Also, FIG. 15 represents improvement rates in rigidity at the intermediate part as A2/A1 and A2/A3. The eighth embodiment has A2/A1 of 211.7% and A2/A3 of 76.0% that are higher than those of the comparative examples A and B.

Based on the comparative example A as illustrated in FIG. 16, according to the eighth embodiment, the improvement rates A2/A1 and A2/A3 in rigidity at the intermediate part relative to the distal part and relative to the proximal part are 53.5% and 11.2% higher than those of the comparative example A, respectively. In FIG. 16, "INTERMEDIATE PART/DISTAL PART" represents the improvement rate A2/A1 and "INTERMEDIATER PART/GRIP" represents the improvement rate A2/A3.

In contrast, according to the comparative example B, the improvement rates in rigidity A2/A1 and A2/A3 at the intermediate part relative to the distal part and relative to the proximal part are 10.5% and 0.7% lower than those of the comparative example A, respectively.

In this way, the eighth embodiment has the rigidity at the intermediate part 1Ga much higher than those at the distal part 1Gb and the proximal part 1Gc.

Figure 17:
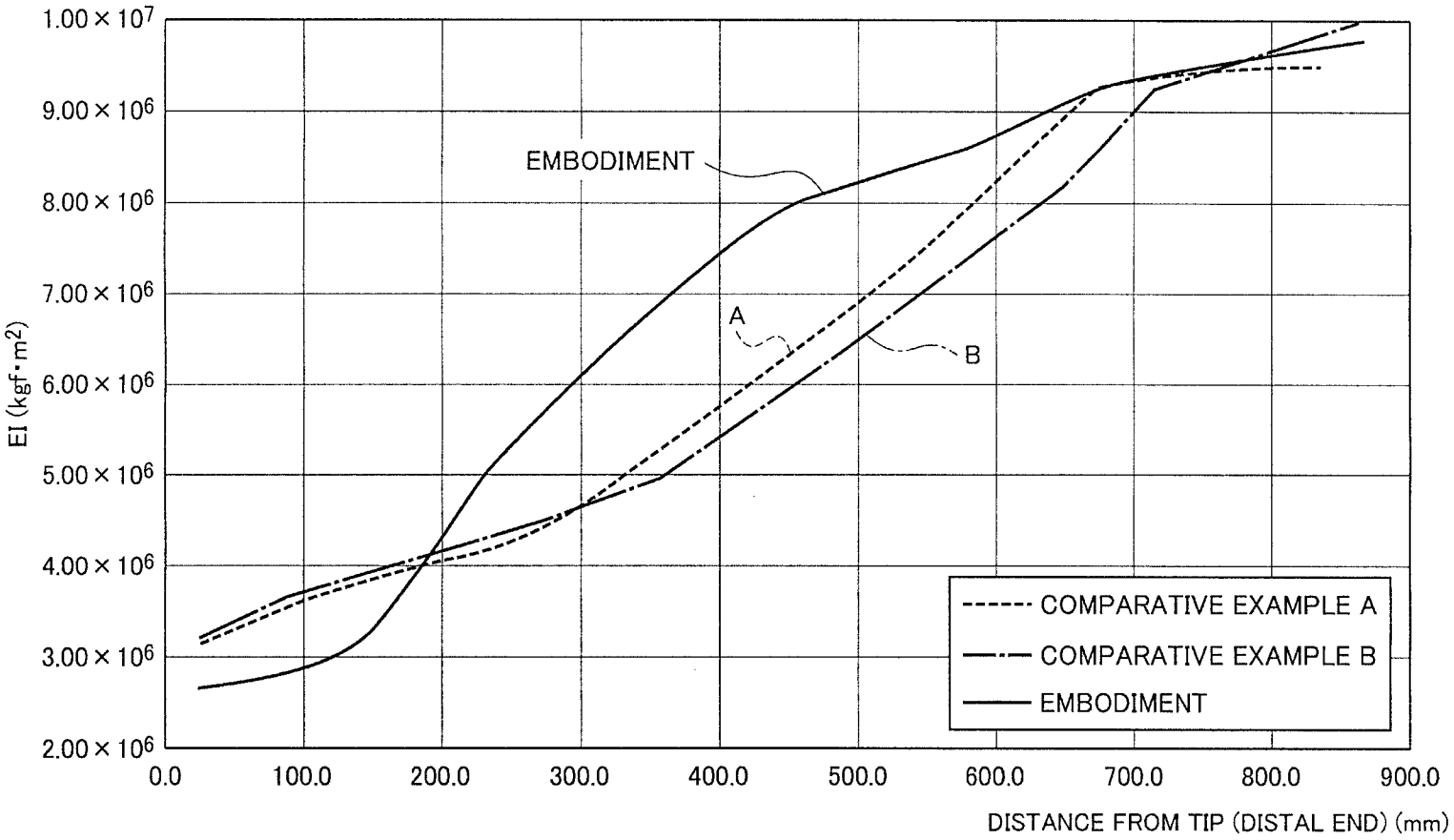
FIG. 17 is a graph illustrating longitudinal changes in rigidity according to the eighth embodiment, comparative example A, and comparative example B.

FIG. 17 is a graph illustrating longitudinally changes in rigidity according to the eighth embodiment, comparative example A, and comparative example B. Each longitudinal change in rigidity in FIG. 17 is a change from the distal part through the intermediate part to the proximal part like FIG. 13.

In FIG. 17, the measurement results obtained by the method of FIG. 14 are represented by continuous curves. The change in rigidity of the eighth embodiment has an inflection point around a portion with a distance of 200 mm from the distal end. Namely, the eighth embodiment improves the rigidity at the intermediate part 1Ga so that the change in rigidity has the inflection point between the distal part 1Gb and the intermediate portion 1Ga.

Figure 18:
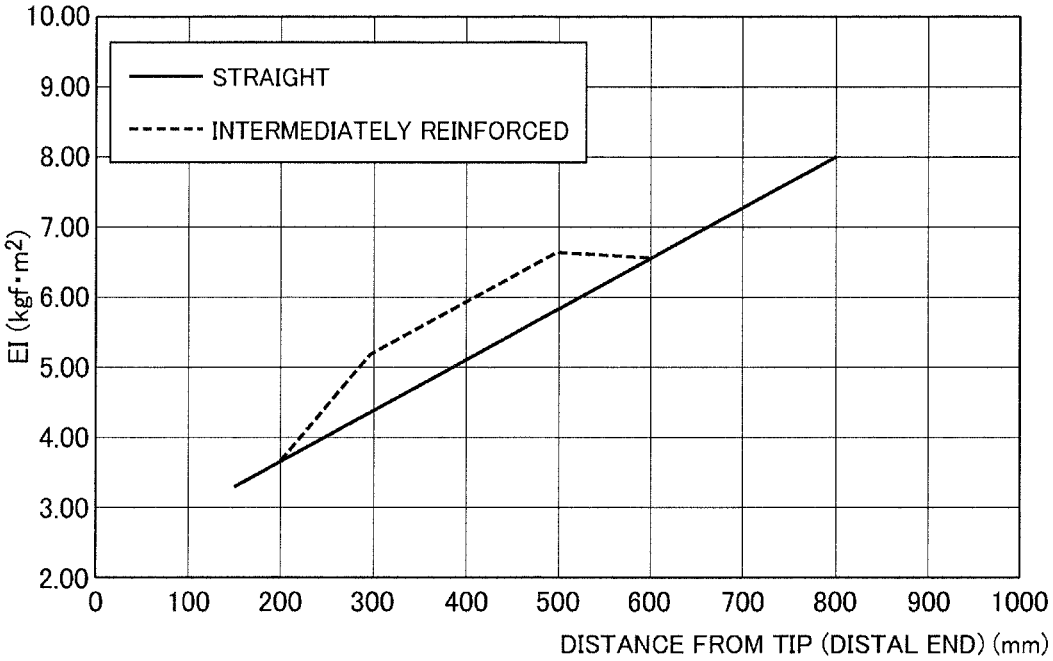
FIG. 18 is a graph schematically illustrating longitudinal change in rigidity according to the eighth embodiment, to emphasize a difference between the eighth embodiment and the reference example.

FIG. 18 is a graph schematically illustrating the longitudinal change in rigidity according to the eighth embodiment, to emphasize a difference between the eighth embodiment and the reference example.

In FIG. 18, a straight line represents a change in rigidity according to the reference example of FIG. 12A that has no thick part as "STRAIGHT," and a bent line represents the change in rigidity according to the eighth embodiment that has the thick part 17G' at the intermediate part 1Ga as "INTERMEDIATELY REINFORCED." In addition, the eighth embodiment has no thick part at the distal and proximal parts 1Gb and 1Gc. Accordingly, the eighth embodiment has the rigidity at the intermediate part 1Ga relative to the distal and proximal parts 1Gb and 1Gc that is about 10% higher than that of the reference example.

Figure 19:
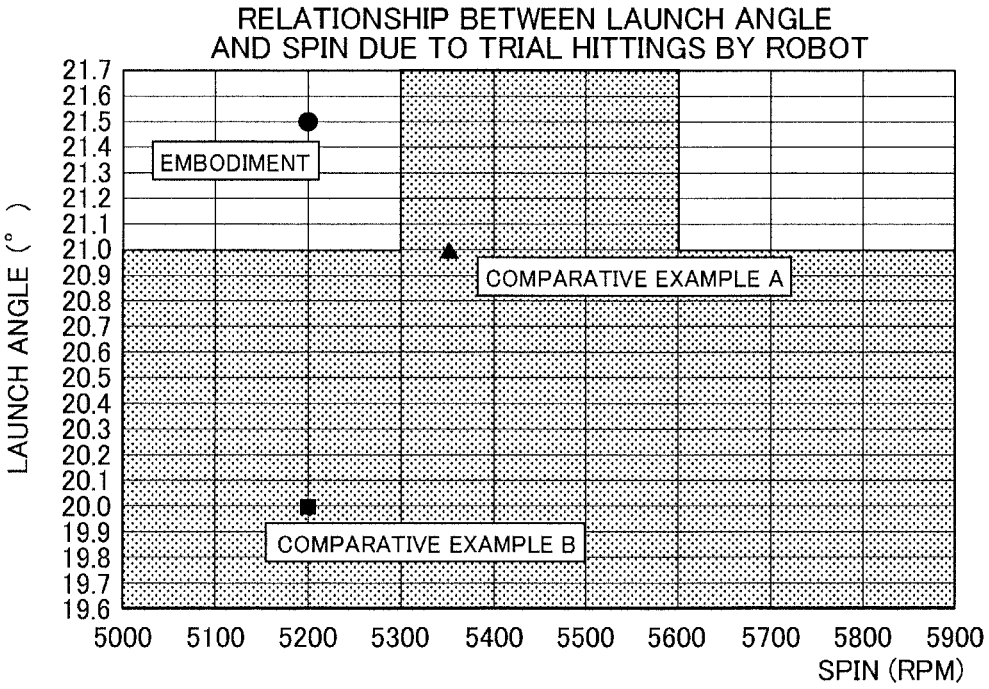
FIG. 19 is a graph illustrating a relationship between a launch angle and a spin according to the eighth embodiment, comparative example A and comparative example B.

FIG. 19 is a graph illustrating a relationship between a launch angle and a spin according to the eighth embodiment, comparative example A and comparative example B.

FIG. 19 represents relationships between a launch angle and a spin that are results of trial hittings with use of golf clubs having the respective stepped shafts according to the eighth embodiment, comparative examples A and B. The trial hittings are carried out by a swinging robot so as to hit a ball with each golf club under the same condition. As illustrated in FIG. 19, the golf club according to the eighth embodiment ("EMBODIMENT" in FIG. 19) provides a launch angle of 21.5° and a spin of 5200 rpm in which the launch angle is higher and the spin is lower than the comparative examples A and B. Therefore, the eighth embodiment allows the golf club to hit a higher ball and reduce spin on the ball.

Figure 20:
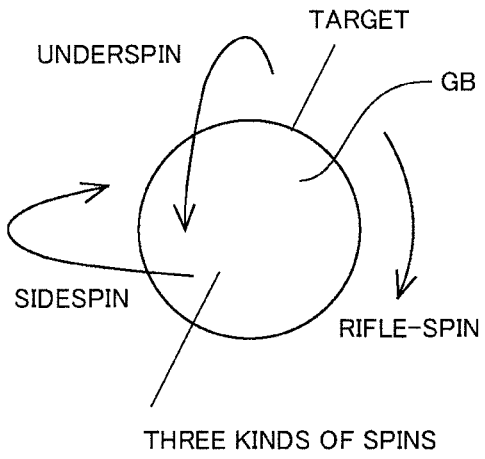
FIG. 20 is a schematic view illustrating a ball with spins according to the eighth embodiment.

An effect or mechanism due to a high ball with a low spin will be explained further with reference to FIGS. 20 to 22. FIG. 20 is a schematic view illustrating a ball with spins, FIG. 21 is a schematic view explaining a relationship between a spin and a lift force acting on a ball, and FIG. 22 is a graph illustrating a relationship between a height and a distance in view of a spin on a ball.

As illustrated in FIG. 20, a hit ball may include three kinds of spins that are an underspin, a sidespin and a rifle-spin. The underspin is vertically on an axis in a target direction so that it has an affect on a flying distance of the ball. The sidespin is laterally on the axis in the target direction and is orthogonal to the underspin so that it has an affect on a lateral sway of the ball. The rifle-spin is a spiral spin around the axis.

Figure 21:
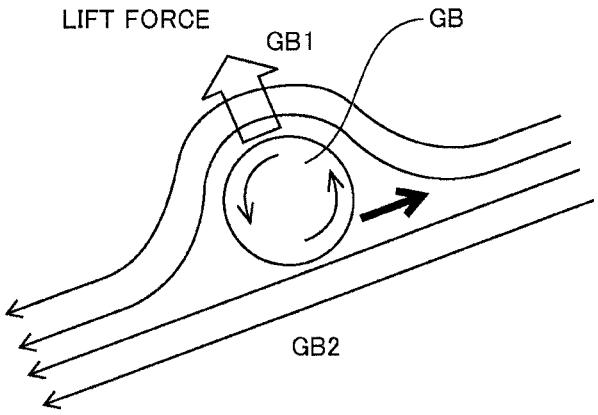
FIG. 21 is a schematic view explaining a relationship between a spin and a lift force acting on a ball according to the eighth embodiment.

The reason why the underspin has the affect on the flying distance is because the underspin generates a lift force as illustrated in FIG. 21. The ball GB with the underspin deforms an airflow to pass through the upside GB1 of the ball GB from front to back. Namely, the airflow passing through the upside GB1 becomes faster than the downside GB2, whereby an air pressure on the upside GB1 becomes lower than the downside GB2 to generate the lift force on the ball GB toward the upside GB1. The lift force changes according to the amount of the underspin.

Figure 22:
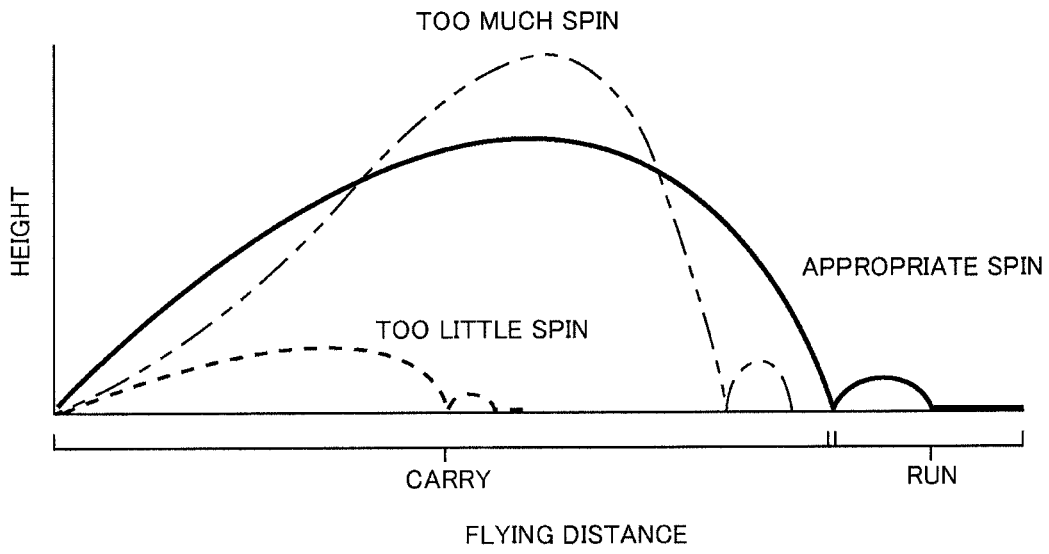
FIG. 22 is a graph illustrating a relationship between a height and a distance in view of a spin on a ball according to the eighth embodiment.

As illustrated in FIG. 22, a ball with too much underspin generates a relatively-large lift force and starts to fly low and then gets gradually higher to draw a parabola. This may cause an overhigh ball to deteriorate a run (a running distance from a first landing point). On the other hand, a ball with too little underspin generates a relatively-small lift force and does not fly high enough for a run and a carry (a flying distance from a launching point to a first landing point). In a trajectory of a ball with an appropriate spin, the ball starts to fly little high and then gets gradually higher so as not to be overhigh. This provides an enough carry and run.

In FIG. 19, a launch angle and spin is appropriate within a left white region in which the stepped shaft of the eighth embodiment is included. This region is confirmed by the inventors to provide a trajectory of a ball that is the characteristics based on the appropriate spin illustrated in FIG. 22.

The eighth embodiment may form the thick part 1G into a similar shape to the third or fifth embodiment or form a reinforcing part instead of or together with the thick part 1G similar to the second, fourth, sixth or seventh embodiment.

In addition, the present invention may form the proximal part to have a wall thickness that is the same as or greater than the intermediate part.

What is claimed is:

1. A shaft for a golf club, comprising:

a tube body; and a thick part formed on the tube body;

wherein the tube body comprises a distal part, a proximal part, and an intermediate part in a longitudinal direction of the shaft;

wherein the distal part is provided with a clubhead and extends from a distal end of the shaft to one end of the intermediate part;

wherein the proximal part is provided with a grip and extends from a proximal end of the shaft to another end of the intermediate part;

wherein the intermediate part is arranged between the distal and proximal parts and is longer than the distal part and proximal part in the longitudinal direction;

wherein the tube body has an outer diameter that gradually increases from the distal end of the distal part toward the proximal end of the proximal part and a wall thickness that gradually decreases from the distal end of the distal part toward the proximal end of the proximal part so that the distal part is relatively thick and the proximal part is relatively thin;

wherein the thick part extends from the one end of the intermediate part to the other end of the intermediate part so as to provide a combined wall thickness of the tube body and thick part at the intermediate part that is thicker than wall thickness along the distal part, thereby improving a rigidity at the intermediate part so that a change in rigidity between the distal part and the intermediate part has an inflection point; and wherein the thick part bulges inward from an inner periphery of the tube body at the intermediate part so as to have a truncated sectional shape, a top surface of the truncated thick part defines inside a tapered hole whose diameter gradually increases from one end portion of the thick part close to the distal part to another end portion of the thick part close to the proximal part, and the end portions of the thick part have tapered faces that gradually reduce a wall thickness of the thick part from the top surface toward the distal part and the proximal part, respectively.

* * * * *